United States Patent [19]

Yoshida et al.

[11] 4,256,519

[45] Mar. 17, 1981

[54] METHOD FOR HEAT TREATMENT OF LOW MELTING POINT-METAL PLATED STEEL BAND

[75] Inventors: Katsuyoshi Yoshida, Toukai; Mitsuo Higashi, Yahata; Tatsuya Kanamaru, Toukai; Motohiro Nakayama, Chita, all of Japan

[73] Assignee: Nippon Steel Corporation, Tokyo, Japan

[21] Appl. No.: 32,882

[22] Filed: Apr. 24, 1979

[51] Int. Cl.[3] ..... C21D 9/52; C21D 9/54

[52] U.S. Cl. ..... 148/156

[58] Field of Search ..... 148/156

[56] References Cited

U.S. PATENT DOCUMENTS

| | | | |
|---|---|---|---|
| 3,562,031 | 2/1971 | Gibson | 148/156 |
| 4,081,296 | 3/1978 | Janatka et al. | 148/156 |

*Primary Examiner*—Howard S. Williams

*Attorney, Agent, or Firm*—Wenderoth, Lind & Ponack

[57] ABSTRACT

A method of and an apparatus for overaging treatment of low melting point-metal plated steel band, in which a hearth roll having surface layer which consists mainly of phenol resin, mineral fiber and small quantity of additive as necessary is used under the overaging treatment temperature range and within weak oxidation, inactive or reducing high temperature gas atmosphere such that the phenol resin substantially does not oxidize and evaporate.

The method and apparatus allow overaging treatment of low melting point-metal plated steel band in continuous annealing furnace having many hearth rolls to guide the steel band, and prevent the low melting point metal from being picked up on the surface of the hearth roll.

12 Claims, 1 Drawing Figure

METHOD FOR HEAT TREATMENT OF LOW MELTING POINT-METAL PLATED STEEL BAND

BACKGROUND OF THE INVENTION

1. Field of the Invention

The present invention relates to heat treatment of a low melting point-metal plated steel band, and more especially to a method of and apparatus for continuous overaging treatment of the metal plated steel band to prevent the low melting point metal from being picked up on the surface of a hearth roll in the overaging treatment furnace.

At the overaging treatment temperature of about 250°-500° C., metal is picked up on the hearth roll surface especially when the temperature is more than 70%, of the melting point of the metal, which is indicated by absolute temperature. Thus, metals or alloys having a melting point of less than about 830° C. must be considered. Such low melting point metals which may be considered for metal plated steel band include zinc, aluminum, tin, lead, alloys containing two or more of these metals, alloys of one or more of these metals and iron, and alloys consisting mainly of one or more of these metals and small quantity of other metals, for example, alloys consisting mainly of zinc and small quantity of one or more of other metals, such as cadmium, lead, magnesium and iron, etc.

In the specification, zinc plated steel band is described as a suitable application, however, as to other metals or alloys the same consideration is applied. Further, the invention relates to steel band surface metal pick up phenomena, so that methods of plating or depositing the metal on the steel surface do not change. For illustrating the metal pick up phenomena, hot dip plating is described in the specification. Other methods, e.g. electroplating, chemical plating, vapor depositing, and ion plating can be applied.

2. Description of the Prior Art

Zinc plated steel plate which is manufactured by in-line anneal type hot dip zinc plating apparatus is quenched after in-line annealing so that the steel is hardened somewhat compared with cold rolled steel plate. As a remedy, by overaging treatment process the steel plate is annealed to precipitate solid solution carbon over saturated in the matrix to grain boundaries. Such overaging treatment is applied to hot rolled or cold rolled steel plate of carbon content 0.01-0.2% by weight and zinc plated at one or both surfaces. However, conventional batch type post annealing is not suitable for mass production. Thus, it is desirable to treat the steel plate by in-line overaging treatment process, i.e. after the steel band is plated in a zinc melt bath, the belt is progressively passed in an overaging furnace.

To successfully perform the in-line overaging treatment process, the steel belt temperature range may be 300°-410° C., atmosphere gas temperature may be 250°-430° C., heat treatment period may be 90-360 sec., and line speed may be 20-180 m/min. Thus, a great many hearth rolls are necessary to perform such long heat treatment period as such high speed.

As the melting point of zinc is 419° C., steel or iron roll, alloy roll and ceramic roll, which are generally used in heating furnace, reducing furnace and cooling furnace of an in-line anneal type hot dip zinc plating plant, can not be used as hearth rolls in an overaging treatment furnace.

The reason is as follows: On the surface of the hearth roll in the overaging furnace, zinc is supplied from the zinc plated steel band surface and is deposited as zinc blocks. Thus, the surface of the zinc plated steel band which passes around the hearth roll for about a half circle under tension forms many small recesses.

The principle that zinc is deposited and progresses on the surface of the hearth roll in the overaging furnace is not clearly determined. According to research of the inventors of the present invention, on a Cr-Ni or Co base alloy roll surface, zinc physically attached on the surface is chemically combined with the roll surface within a short period and can not be removed by physical methods, in a temperature range of the overaging furnace. Zinc chemically combined with the roll surface has more tendency to attach other zinc, than a roll surface which is not attached with zinc, so that zinc progresses selectively to form a projected zinc block.

As to a ceramic roll, zinc is attached in small recesses of the ceramic roll surface and the attached zinc progresses as before. Also, ceramic coating forms a network of cracks, and a small part of the metal roll surface is exposed in the overaging atmosphere. In the very small area, zinc is squeezed into the area by relative movement between the roll and the steel band surface, and forms chemically combined strong zinc deposit.

SUMMARY OF THE INVENTION

Accordingly, the object of the present invention is to provide a method of and an apparatus for heat treatment of low melting point-metal plated steel band, in which such zinc deposit problem is completely eliminated by selecting certain material for the hearth roll and a certain atmosphere gas in the overaging furnace.

According to the present invention, in a method of heat treatment of a low melting point-metal plated steel band for the metal plated steel band, a hearth roll having a surface layer which consists mainly of phenol resin, mineral fiber and small quantity of additive as necessary, is used under the overaging treatment temperature range and within a weak oxidation, inactive or reducing high temperature gas atmosphere such that the phenol resin substantially does not oxidize and evaporate.

Conventionally, laminated or molded asbesto-based phenol resin is used widely as roll, bearing, gear and other machine parts. However, such application utilizes frictional wear property and mechanical property of phenol resin, and environment temperature is room temperature or maximum 200° C. which is a durable temperature of phenol resin under normal atmosphere.

According to the present invention, a hearth roll having a surface layer which consists mainly of phenol resin and mineral fiber is utilized in the overaging furnace. The present invention regulates the atmosphere gas in the furnace such that oxygen concentration in the gas is maintained below a predetermined value. Thus, phenol resin laminate can be used even in a high furnace temperature, i.e. over 200° C. By utilizing the phenol resin as a surface layer of the hearth roll, zinc is not picked up on the roll surface. Thus, according to the present invention, an in-line overaging furnace for treating zinc plated steel band is, for the first time, successfully operated.

One preferred method of manufacturing the hearth roll will be described below.

Web made of mineral fiber is impregnated with phenol resin varnish and dried. Then the web is pressed into tubular form or laminated into tubular form by a rolled tube method. The tube is thermo-set and machined into a desired pipe. Mineral fiber and phenol resin may be mixed, and press formed into a tube under suitable pressure and temperature.

The formed pipe is machined and surface finished. The finished pipe is fit over a core roll to form a hearth roll.

As another manufacturing method, adhesive is applied on a core roll surface, and phenol resin and lamination web are directly wound by a roll tube method. The wound roll is thermo-set and the surface is ground to form the desired hearth roll.

The thickness of the surface layer containing phenol resin is not limited. Actually, surface wear and regrinding are considered to determine suitable thickness.

The phenol resin described in the specification is a resin which is manufactured from the phenol family, including phenol, cresol, xylenol, resorcinol, and derivatives of these materials having a phenyl group, and aldehyde family including formaldehyde. Mineral fiber includes asbestos, glass fiber, slag wool and rock wool. Composition ratio of the mineral fiber and the phenol resin may preferably be within 60:40–40:60 in weight ratio. A small quantity of additive may be added.

Available addition include, carbon fiber, heat resistant resin, e.g. polyoxybenzoyl resins having the formulae

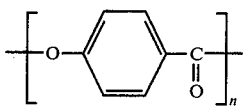

polyimide resins and polyparabenzenesulfinyl resins having the formulae

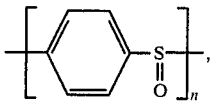

inorganic salts, carbon, rock powders, short mineral fibers, e.g. asbestos, glass wool, slag wool and rock wool, metal oxides, e.g. $Al_2O_3$, $TiO_2$ and $ZrO_2$, boron nitride and silicon-nitride. The quantity of additive, if used, is below 10 weight % of the hearth roll surface layer, and preferably not greather than 5 weight %. The function of the additive is maintain the mechanical strength of the hearth roll at the overaging treatment temperature range, and also to fill small cavities produced between the phenol resin and mineral fiber during manufacture of the hearth roll to prevent oxidation gas from penetrating into the inner parts of the roll. If the additive exceeds 10 weight %, brittleness of the roll increases, and further, its wear resistant property decreases.

Mineral fiber or fine fibers decreases the rate of reduction of mechanical strength of phenol resin at a temperature range 250°–500° C., also suppresses thermal deterioration of phenol resin. The phenol resin adheres the mineral fibers to each other and has high mechanical strength. In the use of the hearth roll, phenol resin effectively operates in a atmospheric temperature range 250°–500° C.

When the hearth roll according to the invention is kept in air more than 72 hours at a temperature 250° C., phenol resin oxidizes and in the evaporates in air, and outermost layer of the hearth roll only the mineral fiber can be seen. Mechanical strength is also decreased greatly, and the roll is inoperative. Thus, at temperature range 250°–500° C., oxidation of phenol resin should be prevented by regulation of atmosphere gas. Oxygen concentration in the atmosphere gas should be below 3% by volume. Ideally, atmosphere gas may be 100% $N_2$ gas. Practically, oxygen can be contained below 1 volume % at 400° C. and below 3 volume % at 250°–300° C. Further, in weak oxidation gas, oxygen involving gas, e.g. $CO_2$ and CO, may be contained such that the plated steel belt is not affected by the gas. Oxygen concentration may be determined by adding oxygen atoms in the atmosphere gas. By regulating the atmosphere gas to prevent phenol resin from oxidation, low melting point metal on the overaging steel band surface is also prevented from oxidation. Consequently outer visibility of the finished steel band is superior. In one side of the plated steel band, exposed steel surface is not deteriorated.

According to the present invention, the continuous overaging apparatus for a low melting point-metal plated steel band includes overaging treatment furnace, a plurality of hearth rolls arranged in the furnace, said hearth rolls having a surface layer which contacts the band and consist mainly of phenol resins, mineral fiber, and small quantity of additive as necessary, and oxygen concentration detecting apparatus to detect oxygen concentration in the furnace.

The apparatus preferably includes oxygen concentration control apparatus and temperature control apparatus.

As a preferable practical application, in a heat treatment apparatus of said low melting point-metal plated steel band including an overaging treatment furnace, a plurality of hearth rolls arranged in the furnace to guide the steel band from inlet to outlet of the furnace, a circulating blower and gas mixer outside the furnace and connected with gas inlets and gas outlets in the furnace to form a circulating system of gas in the furnace, the apparatus preferably includes said circulating system having oxygen concentration detect apparatus, oxygen concentration control apparatus and temperature control apparatus to maintain the oxygen concentration and temperature in the furnace within predetermined values.

BRIEF DESCRIPTION OF THE DRAWING

The FIGURE is an illustration of an apparatus for overaging treatment of zinc plated steel band in accordance with the invention.

DETAILED DESCRIPTION OF PREFERRED EMBODIMENTS

Figure 1:
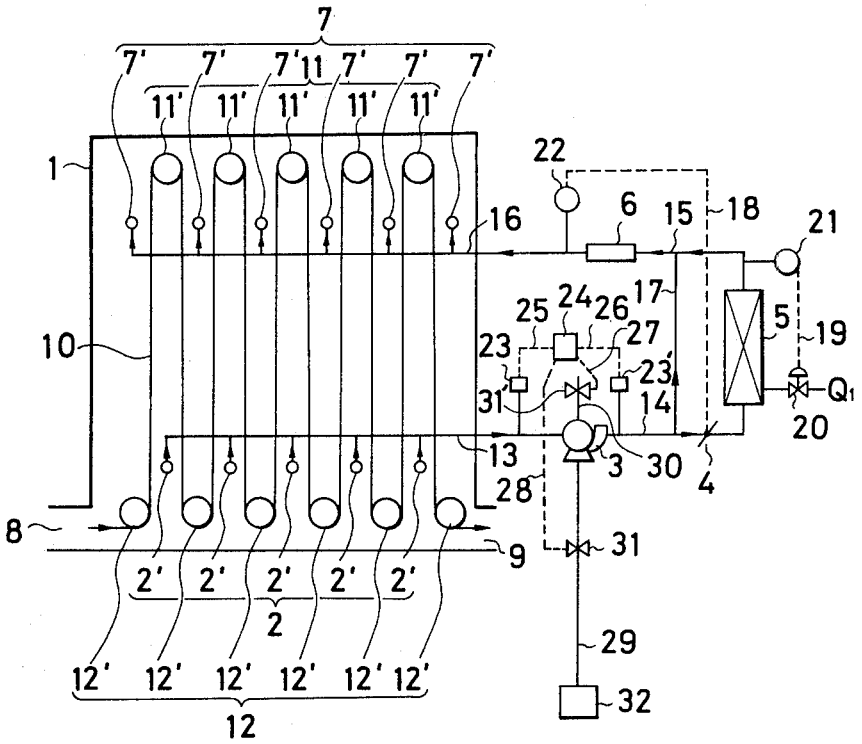

One way of carrying out the invention is described in detail below with reference to the drawing which illustrates only one specific embodiment.

In the FIGURE, overaging furnace 1 has at the lower end of one side an inlet opening 8 to introduce low melting temperature-metal plated steel band 10, and at the lower end of the other side, an outlet opening 9 for the band 10. In the furnace 1, two groups of hearth rolls, i.e. upper hearth roll group 11 and lower hearth roll group 12 are rotatably supported. As shown in the FIGURE, the steel band 10 introduced in the furnace 1 is guided by each hearth roll sequentially so that the steel band 10 moves in the furnace 1 generally vertically upwards and then vertically downwards. Thus, each roll 11' of the upper hearth roll group 11 and each roll 12' of the lower hearth roll group 12 are arranged in the furnace such that each roll 11' or 12' is spaced the same horizontal distance from each adjacent roll of same group and such that each roll 11' or 12' is staggered horizontally in vertical position in relation with rolls to the other group.

Each hearth roll 11' or 12' has a surface layer contacted with the zinc plated steel band 10. The surface layer of the roll consists mainly of phenol resin mixed with mineral fiber and small quantity of additives as necessary.

According to the present invention, in the furnace 1, to prevent phenol resin forming the surface layer of the hearth roll from oxidation and evaporation, weak oxidizing gas, inactive gas and/or reducing gas atmosphere is produced and kept under constant state. The furnace atmosphere gas is circulated between the furnace 1 and a heater 5 which heats the gas to predetermined temperature. Thus, desired overaging temperature is maintained.

Oxygen concentration in the furnace gas is detected by oxygen concentration detectors 23 and 23' and is controlled to the desired concentration by oxygen concentration control apparatus 24 as described below. Gas circulation quantity is determined by heat loss of the furnace 1, and one example is that half volume of the furnace is circulated every minute.

The gas circulation apparatus will now be described. Every suction duct 2' of gas suction duct group 2 is upward and between two lower hearth rolls 12' and is connected with a suction conduit 13. Outside the furnace 1, the suction conduit 13 is connected with inlet of a suction belower 3. Outlet of the suction blower 3 is connected through a conduit 14 with the gas heater 5. When the gas heater 5 is heated by gas or oil, the gas heater 5 is an indirect heating system. The gas in the heater 5 may be heated by electric heater directly. Outlet of the heater 5 is connected through a conduit 15 with a gas mixer 6. Outlet of the gas mixer 6 is connected with a conduit 16. The conduit 16 passes into the furnace 1 and is connected with each supply conduit 7' of a supply outlet group 7. Each supply outlet 7' is arranged below and between two upper hearth rolls 11'.

A branch conduit 17 is connected between the conduits 14 and 15 so that a portion of the returned gas is directly supplied to the gas mixer 6 without passing through the heater 5. Downstream of the connection with the branch conduit 17, the conduit 14 includes a damper 4 which controls gas quantity which flows into the heater 5.

Outlet side of the heater 5 has a temperature controller 21 which detects gas temperature and controls, by signal line 19, a control valve 20 which controls fuel quantity $Q_1$ to heat the heater 5, and maintain the gas temperature to desired constant value.

To control temperature of gas in the supply conduit 16, a temperature controller 22 detects gas temperature in the outlet of the gas mixer 6 and supplies control signal 18 to the damper 4 and controls by-pass gas quantity by regulating the opening of the damper 4. For example, gas supply temperature in the conduit 16 is 400° C., gas temperature in the outlet of the heater 5 is 600° C., by-pass gas temperature in the conduit 17 is 350° C., and total gas circulation quantity is 400 $Nm^3$/min, then the damper 4 is regulated such that 75 $Nm^3$/min of gas passes through the heater 5 and other gas passes through the branch conduit 17.

Oxygen concentration of the atmosphere gas in the furnace 1 is detected by oxygen concentration detectors 23 and 23' which measures gas in the conduits 13 and 14 respectively. The oxygen concentration detectors 23 and 23' are coupled with oxygen concentration control apparatus 24. The oxygen concentration control apparatus 24 receives output signals from the detectors 23 and 23' by control signals 25 and 26 respectively and supplies command signals 27 and 28 to gas regulators 31' and 31 respectively. The gas regulator 31 generates gas quantity in a conduit 29 which is connected between a gas reservoir 32 and inlet side of the blower 3, so that new gas quantity to be added is regulated. The gas regulator 31' regulates gas quantity in a conduit 30 which is connected between outlet side of the blower 3 and air so that gas quantity to be exhausted in the air is regulated. Thus, by controlling the regulators 31 and 31', oxygen concentration in the atmosphere gas is regulated within a desired range, and also atmospheric gas pressure in the furnace is maintained to the desired value, to prevent outside air from flowing excessively in the furnace 1.

According to the present invention, temperature and oxygen concentration of the atmosphere gas in the furnace are maintained to desired constant levels. Phenol resin forms a surface layer of the hearth rolls 11' and 12' which contact with zinc or other low melting point metal which is plated on the steel band 10. In the atmosphere gas, phenol resin does not deteriorate at the overaging temperature. Thus, according to the present invention, in the overaging temperature process of low melting point-metal plated steel band by means of continuous annealing furnace, the low melting point metal is prevented from causing "pick-up" on the hearth roll surface.

Some examples are described below.

EXAMPLE 1

A laminated tube consisting of phenol resin (56 weight %) and asbestos web is formed by a rolled tube process. The tube is fitted on a core roll as a sleeve, and surface ground to outside diameter 1000 mm. The finished hearth roll is mounted in an overaging furnace maintaining atmosphere gas of 400° C. and 0.3% of oxygen and the balance nitrogen. Zinc plated steel band is passed around the roll in a half circle at a tension 0.6 $Kg/mm^2$, and line speed 100 m/min. The steel belt temperature was 380° C. and the roll slips about 2%. After continuous operation of two months, zinc quantity which had picked up on the surface of the rolls was 1.2 $g/m^2$. No recognizable zinc block was seen, no defect was seen on the belt. Roll surface wear was 0.6 mm, and no surface layer separation or crack was seen.

EXAMPLE 2

Glass fiber based-phenol resin sleeve-fitted hearth roll was used. Atmosphere gas was maintained to a temperature 300° C. and a composition of 2.8% $O_2$ and the balance $N_2$. The other conditions were the same as Example 1. Zinc plated steel band was passed in the overaging furance continuously for one month. Zinc quantity picked up on the surface of the hearth roll was 0.3 $g/m^2$. No zinc block on the surface was seen. No defect on the steel band was seen. Surface wear of the roll was 1.2 mm. No separation or defect of the surface layer of the roll was seen.

EXAMPLE 3

A sheet consisting of 50 weight % of slag wool, 4 weight % of carbon, and 46 weight % of phenol resin was wound on a core roll and formed. The roll was surface ground and finished to a hearth roll of outside diameter 600 mm. The hearth roll was supported in an overaging furnace. Atmosphere gas in the furnace was maintained to a temperature 480° C. and composition 0.01% $O_2$, 2% $H_2$ and the balance $N_2$. Aluminum plated steel band was passed in a half circle around the hearth roll at a tension 1.0 $Kg/mm^2$ and a line speed of 60 m/min. The steel belt temperature was 450° C. and the roll slipped 1.5% as mean value. After one month contenuous operation, aluminum picked up on the roll surface was 0.2 $g/m^2$. No metal block on the surface was seen. No defect on the steel belt was seen. Surface wear of the roll was 1.1 mm. No separation or defect of the surface of the roll was seen.

EXAMPLE 4, AS COMPARISON

Steel roll was used. Other conditions were the same as Example 1. Zinc plated steel band was passed in the same overaging furance. After continuous operation of one day, many zinc blocks of diameters 1–10 mm were deposited on the surface of the roll. Surface irregularity of the roll was severe. Many recesses were produced on the surface of the steel band.

What is claimed is:

1. A method of heat treating a low melting point-metal plated steel band for overaging said band, characterized in that a hearth roll having a surface layer which consists mainly of a phenol resin and mineral fiber is used at the overaging treatment temperature range and within a substantially non-oxidizing gaseous atmosphere such that the phenol resin substantially does not oxidize and evaporate.

2. A method as claimed in claim 1, in which said surface layer further contains an additive which maintains the mechanical strength of said hearth roll at the overaging treatment temperature range, and prevents the gaseous atmosphere from penetrating into the inner parts of said hearth roll, the amount of said additive being below 10 weight % based on the weight of said surface layer.

3. A method as claimed in claim 2, in which said additive is one or more of carbon fiber, heat resistant resin, carbon, rock powders, metal oxides, boron nitride and silicon nitride.

4. A method as claimed in claim 2, in which said amount of additive is not greater than 5 weight % of the surface layer.

5. A method as claimed in claim 3, in which said heat resistant resin is selected from the group consisting of a poly(oxybenzoyl) resin, a polyimide resin and a poly(-parabenzenesulfinyl) resin.

6. A method as claimed in claim 3, in which said metal oxide is selected from the group consisting of $Al_2O_3$, $TiO_2$ and $ZrO_2$.

7. A method as claimed in claim 1 or 2, in which said low melting point metal is a metal or metal alloy of melting point below 830° C.

8. A method as claimed in claim 7, in which said low melting point metal is selected from the group consisting of zinc, aluminum, tin, lead, an alloy of two or more of said metals, an alloy containing one of said metals and iron, and a zinc alloy containing cadmium or magnesium.

9. A method as claimed in claim 1 or 2, in which said steel band is a hot rolled steel band or cold rolled steel band.

10. A method as claimed in claim 1 or 2, in which said mineral fiber is one or more of asbestos glass fiber, slag wool and rock wool.

11. A method as claimed in claim 1 or 2, in which said gaseous atmosphere has a temperature 250°–500° C. and an oxygen concentration below 3 volume %.

12. A method as claimed in claim 1 or 2, in which said low melting point-metal plated steel band is a zinc plated steel band which is manufactured by a hot dip zinc plating apparatus, said gaseous atmosphere has a temperature of 250°–430° C. and is inactive gas containing oxygen below 3 volume %.

* * * * *